US012258698B2

(12) United States Patent
Zheng et al.

(10) Patent No.: US 12,258,698 B2
(45) Date of Patent: Mar. 25, 2025

(54) STEAM DRYER AND DRAINAGE DEVICE THEREOF

(71) Applicant: Tsann Kuen (Zhangzhou) Enterprise Co., Ltd., Fujian (CN)

(72) Inventors: Zhenxing Zheng, Fujian (CN); Ronghuang Chen, Fujian (CN); Ruifeng Cai, Fujian (CN)

(73) Assignee: TSANN KUEN (ZHANGZHOU) ENTERPRISE CO., LTD., Fujian (CN)

( * ) Notice: Subject to any disclaimer, the term of this patent is extended or adjusted under 35 U.S.C. 154(b) by 854 days.

(21) Appl. No.: 17/396,120

(22) Filed: Aug. 6, 2021

(65) Prior Publication Data

US 2022/0049413 A1 Feb. 17, 2022

(30) Foreign Application Priority Data

Aug. 13, 2020 (CN) ..... 202010812471.8

(51) Int. Cl.
*D06F 58/20* (2006.01)
*D06F 58/14* (2006.01)
*D06F 58/24* (2006.01)

(52) U.S. Cl.
CPC ..... *D06F 58/203* (2013.01); *D06F 58/14* (2013.01); *D06F 58/24* (2013.01)

(58) Field of Classification Search
CPC ..... D06F 73/02
See application file for complete search history.

(56) References Cited

U.S. PATENT DOCUMENTS 5,094,020 A 3/1992 Wingfield et al.
2020/0080254 A1 3/2020 Chang et al.

FOREIGN PATENT DOCUMENTS

CN 101517144 A * 8/2009 ..... D06F 58/20
CN 106350980 A 1/2017
CN 106524109 A 3/2017
CN 207506376 U 6/2018
CN 208701381 U 4/2019
EP 2213781 A1 8/2010
(Continued)

OTHER PUBLICATIONS

Search Report appended to an Office Action, which was issued to Chinese counterpart application No. 202010812471.8 by the CNIPA on Apr. 25, 2023 with an English translation thereof.
(Continued)

*Primary Examiner* — Jason Lau
(74) *Attorney, Agent, or Firm* — Muncy, Geissler, Olds & Lowe, P.C.

(57) ABSTRACT

A drainage device for a steam dryer defining a space includes a container, a steam generator connected to the container, and a steam diverging device connected to the container and the steam generator. The container supplies water to the steam generator. The steam diverging device includes a connecting passage for communicating with the space. The steam generator generates steam that is ejected through the steam diverging device into the space, and water generated by the condensation of the steam flows back to the container through the steam diverging device. A steam dryer having the drainage device is also disclosed.

14 Claims, 8 Drawing Sheets

(56) References Cited

FOREIGN PATENT DOCUMENTS

KR 101430459 B1 * 8/2014

OTHER PUBLICATIONS

Search Report appended to an Office Action, which was issued to Chinese counterpart application No. 202010812471.8 by the CNIPA on Apr. 30, 2024, with an English translation thereof.
Search Report issued to European counterpart application No. 21190899.1 by the EPO on Dec. 13, 2021.

* cited by examiner

STEAM DRYER AND DRAINAGE DEVICE THEREOF

CROSS-REFERENCE TO RELATED APPLICATION

This application claims priority to Chinese Patent Application No. 202010812471.8, filed on Aug. 13, 2020.

FIELD

The disclosure relates to a household appliance, more particularly to a steam dryer and its drainage device.

BACKGROUND

In a conventional steam dryer, due to the limited power and volume of the heating element, water cannot be completely vaporized, so that steam mixed with water is ejected which easily causes accumulation of water inside the machine. The usual method of solving this problem is to mount a waste water tank inside the machine. When water in the tank is full, the tank is taken out of the machine, and the accumulated water is removed therefrom. However, this method has the following disadvantages:

1. Since the volume of the waste water tank is limited, the tank is frequently removed, so that it is inconvenient to use.
2. Accumulated water in the waste water tank can easily cause odors and contamination.
3. Since it is easy to cause waste water to flow to a working platform or ground when the waste water is removed from the tank, the waste water tank must be sealed.

The conventional steam dryer also has the problem of easy accumulation of condensate which can block a steam outlet thereof, so that not only will the steam impact the condensate and cause noise, but it will also cause water to accumulate inside the machine. The usual solution to this problem is to enlarge the outlet diameter and reduce contact between the steam and the outlet part. However, this method can easily cause weak steam injection and cannot effectively solve the condensate problem.

SUMMARY

Therefore, an object of the present disclosure is to provide a steam dryer and its drainage device that can alleviate at least one of the drawbacks of the prior art.

According to one aspect of this disclosure, a drainage device for a steam dryer includes a container, a steam generator connected to the container, and a steam diverging device connected to the container and the steam generator. The steam dryer defines a space. The container supplies water to the steam generator. The steam diverging device includes a connecting passage for communicating with the space. The steam generator generates steam that is ejected through the steam diverging device into the space, and water generated by the condensation of the steam flows back to the container through the steam diverging device.

According to another aspect of this disclosure, a steam dryer defining a space for accommodating clothes to be dried includes a drainage device. The drainage device includes a container, a steam generator connected to the container, and a steam diverging device connected to the container and the steam generator. The container supplies water to the steam generator. The steam diverging device includes a connecting passage communicating with the space. The steam generator generates steam that is ejected through the steam diverging device into the space, and water generated by the condensation of the steam flows back to the container through the steam diverging device.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
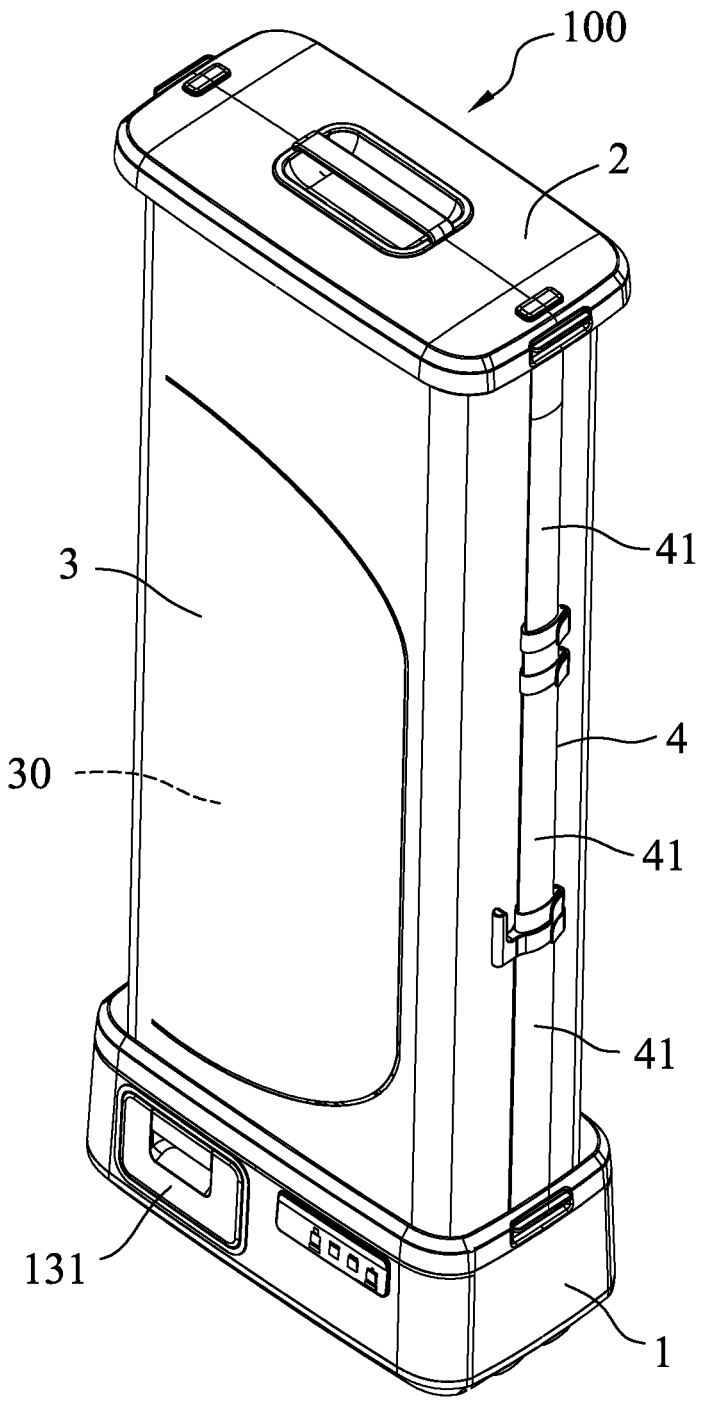
FIG. 1 is a perspective view of a steam dryer according to an embodiment of the present disclosure.

Referring to FIGS. 1 to 8, a steam dryer 100 according to an embodiment of the present disclosure includes a main body 1, a cover body 2, a cloth cover 3, and two telescopic tubes 4.

Figure 2:
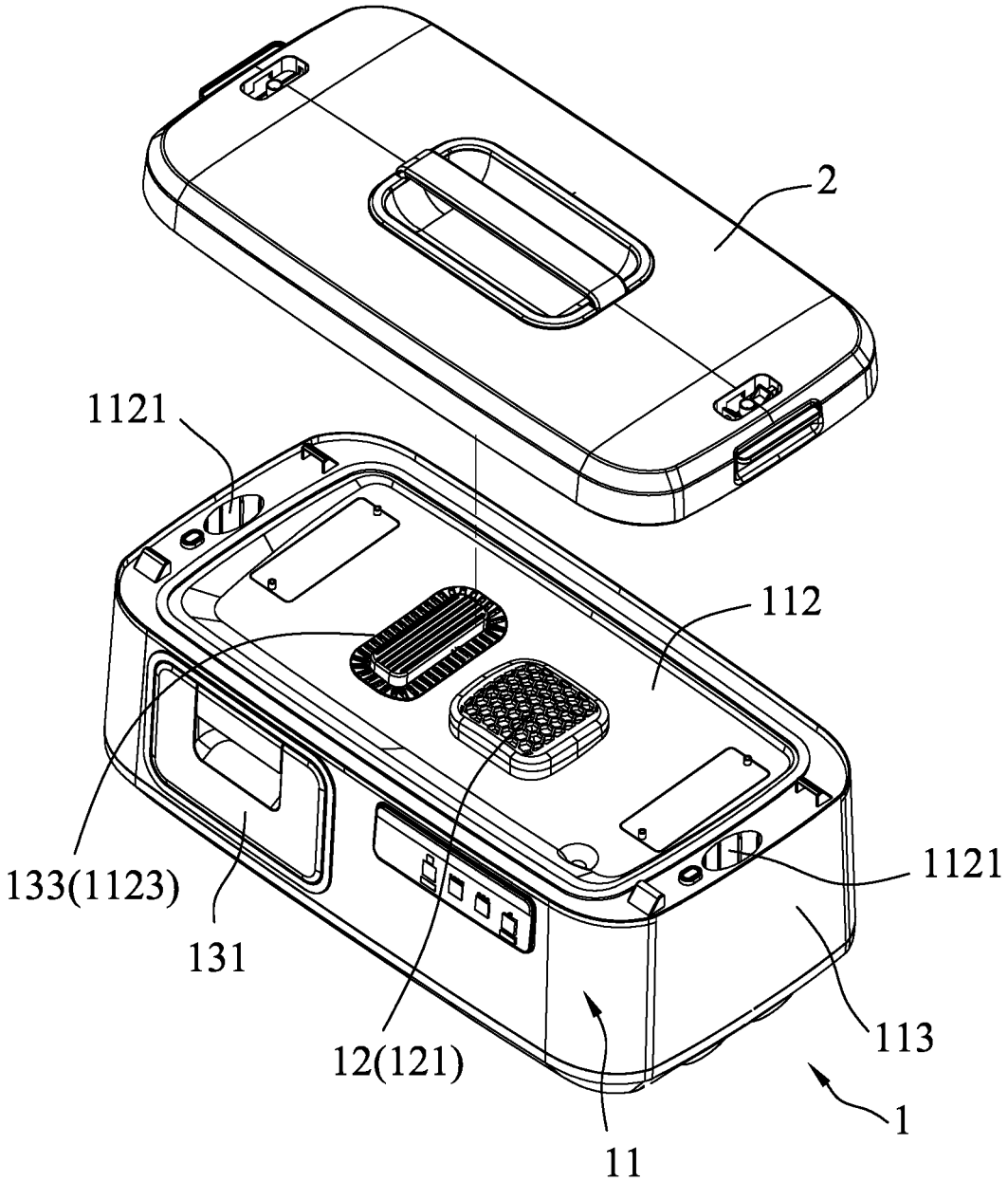
FIG. 2 is a perspective view of a main body and a cover body of the steam dryer of the embodiment.
Figure 3:
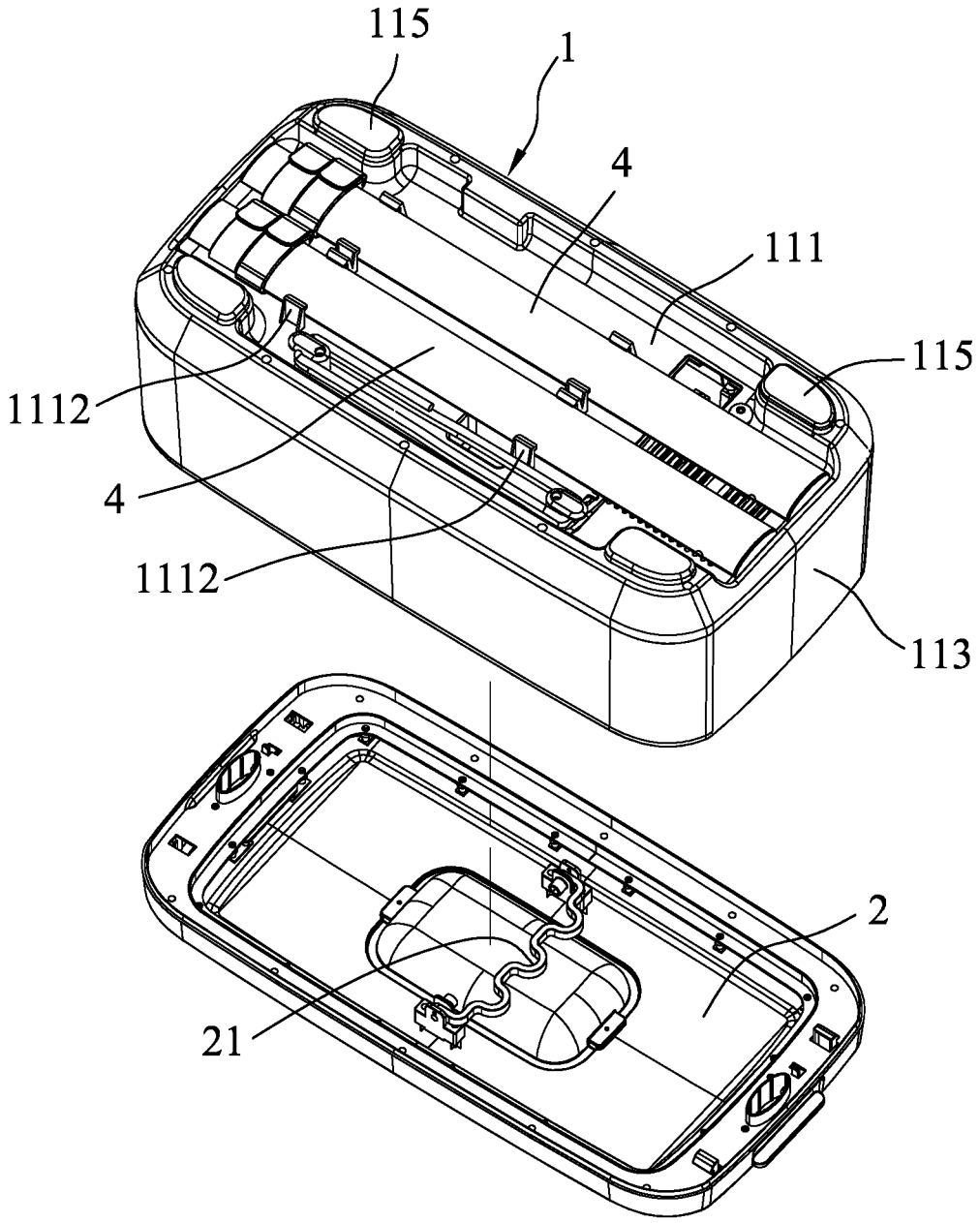
FIG. 3 is a bottom perspective view of the main body and the cover body of the steam dryer of the embodiment.
Figure 4:
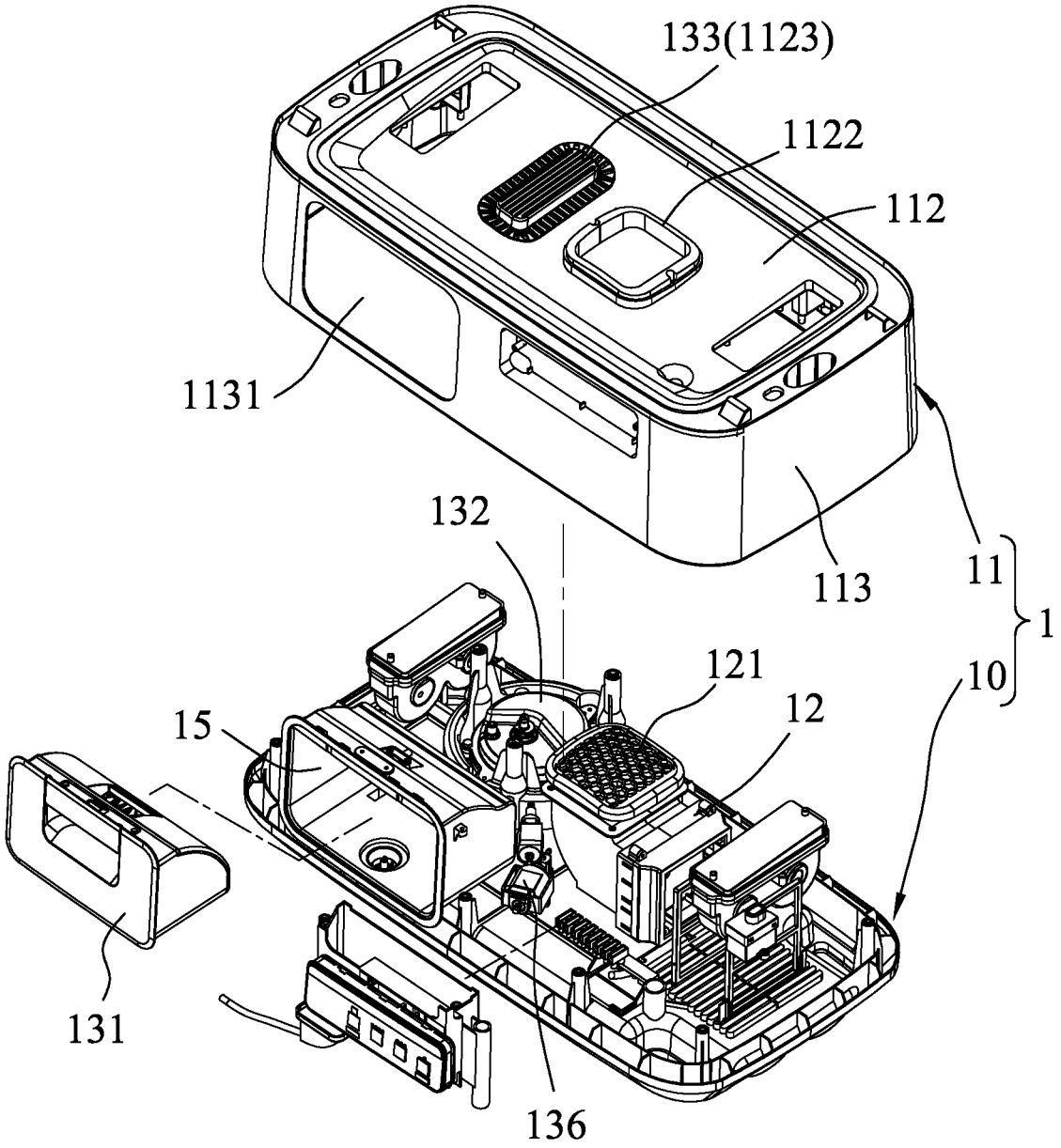
FIG. 4 is a partially exploded perspective view of the main body of the steam dryer of the embodiment.

With reference to FIGS. 2 to 4, the main body 1 includes a base plate 10 and an upper housing 11 covering the base plate 10. The base plate 10 has a receiving groove 111 formed in a bottom side thereof. The receiving groove 111 communicates with the outside. Four foot pads 115 are provided on the bottom side of the base plate 10, and surround the receiving groove 111. A plurality of pairs of retaining members 1112 are provided on the bottom of the receiving groove 111.

The upper housing 11 has a top wall 112 opposite to the receiving groove 111, a surrounding wall 113 extending downwardly from an outer periphery of the top wall 112 and cooperating with the same to cover the base plate 10, and two insertion holes 1121 respectively provided on two opposite sides of the top wall 112. The surrounding wall 113 has a rectangular opening slot 1131.

Each telescopic tube 4 includes three tubular sections 41 arranged telescopically with respect to one another. When each telescopic tube 4 is retracted to a shortest state, it has a length equal to a length of one tubular section 41. The telescopic tubes 4 can be removably inserted into the receiving groove 111 when retracted to the shortest state, and are retained therein by the pairs of retaining members 1112 to facilitate storage thereof.

When each telescopic tube 4 is extended to a longest state, a first end thereof can be inserted into a respective one of the insertion holes 1121, so that each telescopic tube 4 extends upwardly and vertically from the top wall 112, and a second end thereof is opposite to the first end in a vertical direction.

The cover body 2 is removably connected to the second ends of the telescopic tubes 4, and is spaced apart from the top wall 112 in the vertical direction.

The cloth cover 3 is removably disposed between the top wall 112 and the cover body 2 and between the telescopic tubes 4, and defines a space 30. The top wall 112 defines a bottom portion of the space 30. The cover body 2 is provided with a hanging member 21 at a side facing the space 30, so that clothes (not shown) can be hung in the space 30 through the hanging member 21.

When the cover body 2, the cloth cover 3 and the telescopic tubes 4 are disassembled, the cover body 2 can be directly disposed on the top wall 112 and can cooperate with the same to define a storing space therebetween, the cloth cover 3 is folded and stored in the storing space, and the telescopic tubes 4 are disposed in the receiving groove 111, thereby placing the steam dryer 100 in a storage state.

The main body 1 further includes a blowing device 12 disposed on a top side of the base plate 10. The blowing device 12 has a top portion extending into a hole 1122 in the top wall 112 and provided with a plurality of air outlet holes 121 communicating with the space 30. The blowing device 12 is used to generate hot air and blow the clothes placed in the space 30 for drying the same. The blowing device 12 may be a combination of a common fan and an electric heating wire, or other common devices, as long as it can generate hot air for drying the clothes. Since the blowing device 12 is not an important aspect of this disclosure, a detailed description thereof is omitted herein.

The main body 1 further includes a drainage device 13. The drainage device 13 includes a container 131, a steam generator 132 and a steam diverging device 133. In this embodiment, the steam generator 132 is a steam boiler disposed on the top side of the base plate 10 in proximity to the blowing device 12. The steam diverging device 133 is fixed to a hole 1123 in the top wall 112 of the upper housing 11, and is located on the bottom portion of the space 30. Further, the steam diverging device 133 is connected to the steam generator 132 and the container 131, and includes a connecting passage communicating with the space 30. The steam generator 132 is connected to the container 131. The container 131 supplies water to the steam generator 132. The steam generator 132 generates steam and is ejected through the steam diverging device 133 into the space 30, and water generated by the condensation of the steam flows back to the container 131 through the steam diverging device 133.

The main body 1 further includes a receptacle 15 (see FIG. 4) disposed on the top side of the base plate 10 in proximity to the steam generator 132 and having an opening that registered with the opening slot 1131. The container 131 is removably and slidably disposed in the receptacle 15 through the opening slot 1131.

During the operation of the steam dryer 100, steam is first generated by the steam generator 132, after which the steam flows through the steam diverging device 133 into the space 30 for steaming the clothes therein. The wrinkles of the clothes are softened under the action of the steam and are flattened under the weight of the clothes itself. During the continuous steaming process of the steam generator 132, part of the steam will be condensed and accumulated in the steam diverging device 133. At this time, because the steam diverging device 133 is connected to the container 131, the condensate can flow to the container 131. Further, steam in the space 30 may condense and drip onto the top wall 112 of the upper housing 11. At this time, the condensate on the top wall 112 can enter the steam diverging device 133 through the connecting passage and flow to the container 131.

Figure 5:
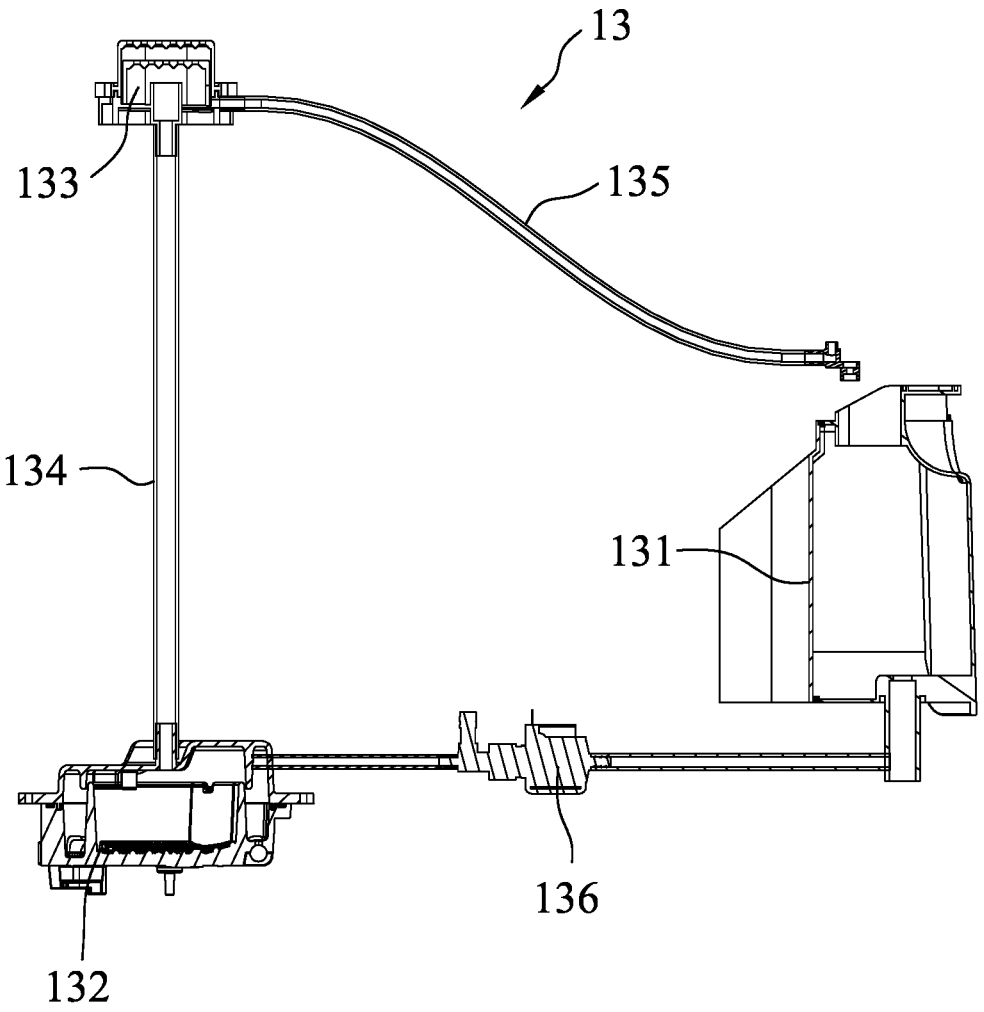
FIG. 5 is a schematic view of a drainage device of the embodiment, illustrating how the components thereof are interconnected.
Figure 6:
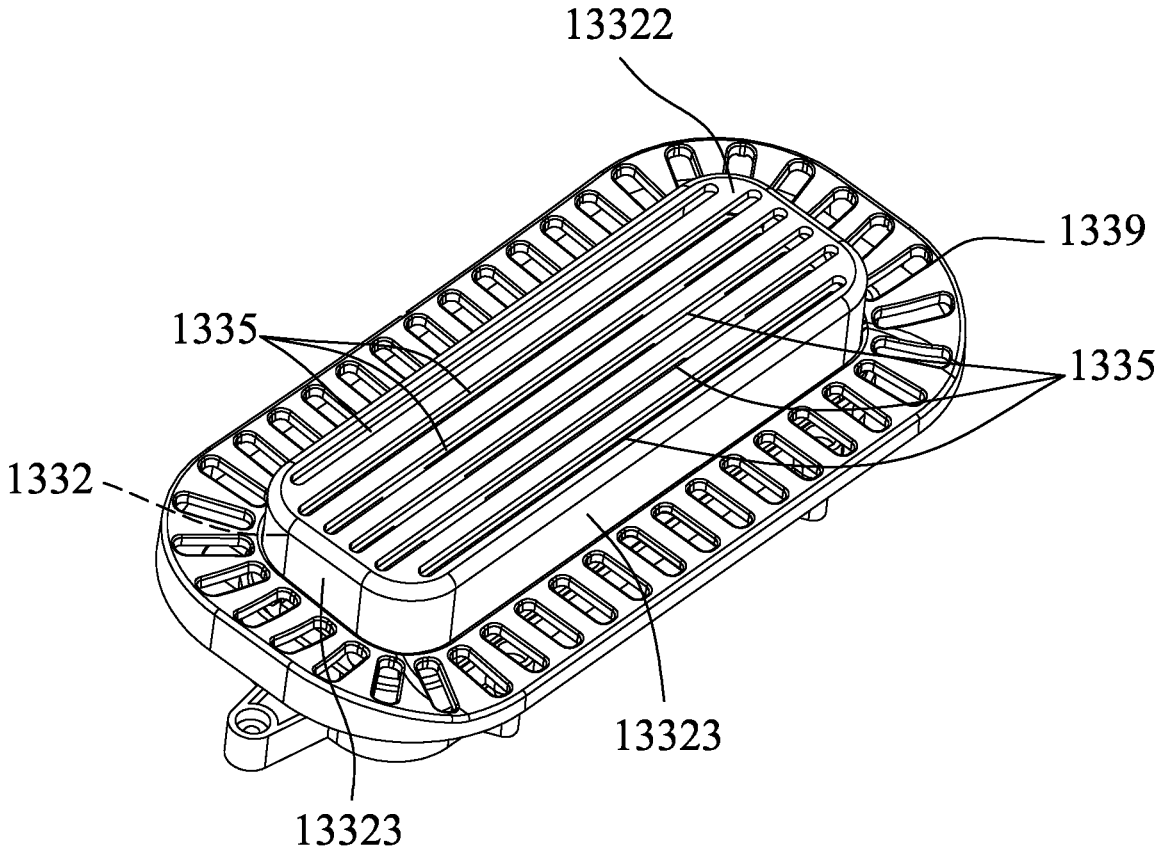
FIG. 6 is a perspective view of a steam diverging device of the embodiment.
Figure 7:
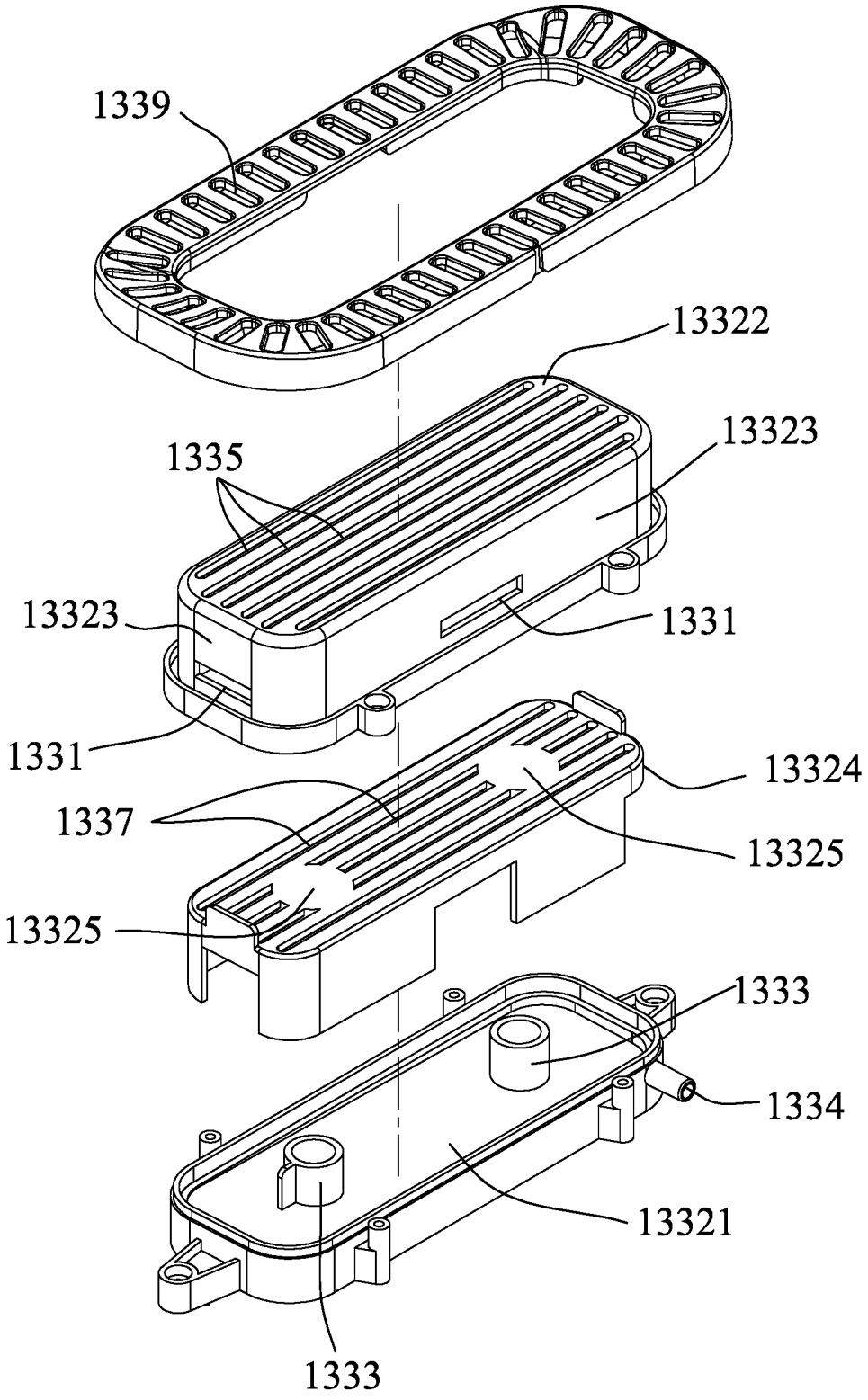
FIG. 7 is an exploded perspective view of the steam diverging device of the embodiment.
Figure 8:
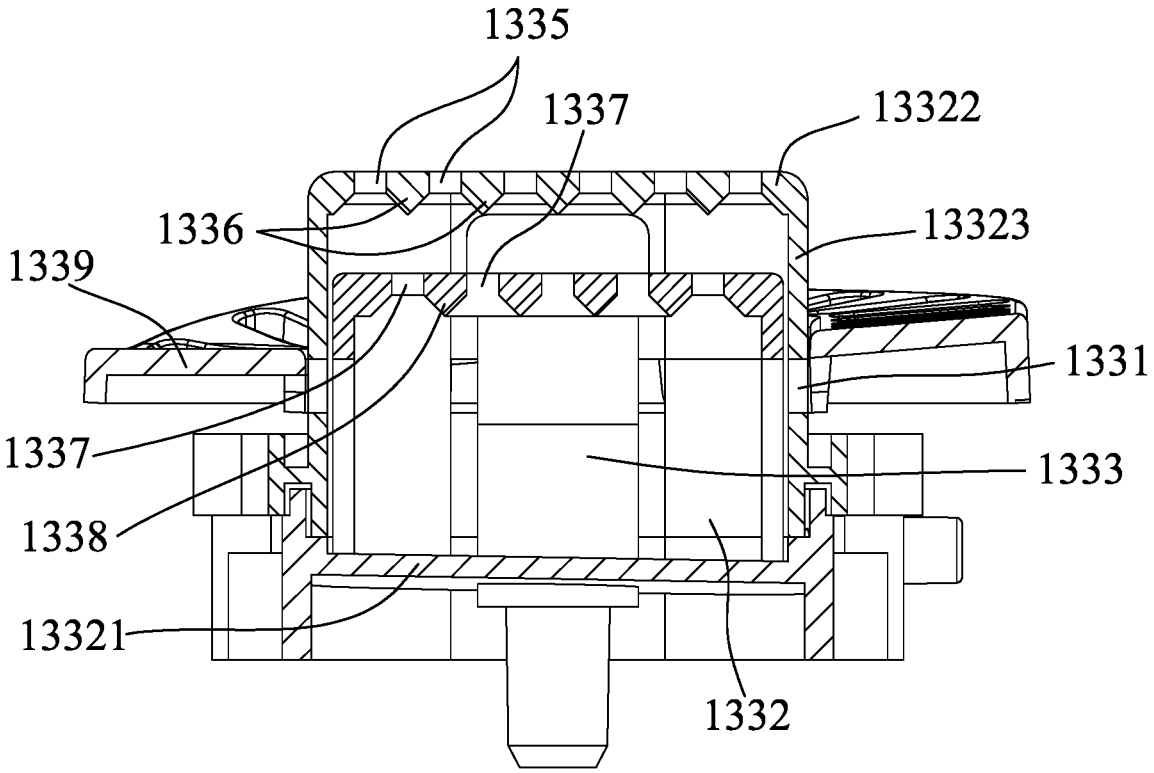
FIG. 8 is an assembled sectional view of the steam diverging device of the embodiment.

The steam diverging device 133 is disposed higher than the steam generator 132. The steam diverging device 133 is connected to the steam generator 132 through two guide pipes 134 (only one is shown in FIG. 5), and is connected to the container 131 through a return pipe 135. In this embodiment, the return pipe 135 is connected to a top portion of the container 131, and the steam diverging device 133 is disposed higher than the container 131, so that water in the steam diverging device 133 can flow toward the container 131 under the action of gravity.

A pumping device 136 is disposed between the steam generator 132 and the container 131 for pumping water in the container 131 to the steam generator 132. The pumping device 136 is a water pump, and has a water pumping end connected to a bottom portion of the container 131, and a water outlet end connected to the steam generator 132. During the operation, the pumping device 136 is activated to pump water from the container 131 to the steam generator 132, the steam generator 132 then heats the water to vaporize the water into steam, and the steam flows into the steam diverging device 133 through the guide pipes 134.

The steam diverging device 133 further includes a chamber 1332 having a bottom wall 13321, and two spaced-apart tubular stubs 1333 protruding upwardly from the bottom wall 13321 and respectively connected to the guide pipes 134 for fluid communication with the steam generator 132. When there is condensate on the bottom wall 13321 of the chamber 1332, the tubular stubs 1333 can prevent the condensate from flowing into the guide pipes 134, so that noise caused by steam impacting the condensate can be prevented.

In this embodiment, the bottom wall 13321 of the chamber 1332 is disposed higher than the container 131, and the connecting passage includes four through passages 1331 respectively provided in four side walls 13323 of the chamber 1332. The steam diverging device 133 further includes a water outlet 1334 connected to the return pipe 135 so as to communicate the chamber 1332 and the container 131. The water outlet 1334 is located at the lowest point of the bottom wall 13321 of the chamber 1332, so that water in the chamber 1332 can flow into the water outlet 1334.

The chamber 1332 further has an upper wall 13322 provided with a plurality of spaced-apart first channels 1335 and a plurality of first guide blocks 1336. Each first guide block 1336 is disposed between two adjacent ones of the first channels 1335, extends downwardly from the upper wall 13322, and gradually decreases in diameter toward the bottom wall 13321 of the chamber 1332. Since steam ejecting out of the tubular stubs 1333 may contain large water droplets, the first guide blocks 1336 can break up the large water droplets, and reduce contact area between the water droplets and the corresponding first channels 1335, so that the water droplets can be prevented from adhering to surfaces of the first guide blocks 1336, forming excessive condensate or condensed water. Further, when the condensate in the space 30 drip onto the upper wall 13322 of the chamber 1332, the condensed water can rapidly flow into the chamber 1332 through each first guide block 1336, thereby accelerating the efficiency of drainage.

The chamber 1332 further has an intermediate wall 13324 located between the bottom wall 13321 and the upper wall 13322. The intermediate wall 13324 is provided with a plurality of spaced-apart second channels 1337 and a plurality of second guide blocks 1338. Each second guide block 1338 is disposed between two adjacent ones of the second channels 1337, extends downwardly from the intermediate wall 13324, and gradually decreases in diameter toward the bottom wall 13321 of the chamber 1332. Since each second guide block 1338 has the same effect as each first guide block 1336, a detailed description thereof is omitted herein. The second guide blocks 1338 are staggered with the first guide blocks 1336. Since steam flowing out of each second channel 1337 may contain water droplets, through the staggered arrangement of the first and second guide blocks 1336, 1338, the water droplets can be efficiently prevented from directly flowing into the space 30.

In this embodiment, each of the first and second channels 1335, 1337 is a horizontal slot extending in a straight direction. In other alternatives, each of the first and second channels 1335, 1337 may be a curved slot, a round hole, a square hole, or any other shape, and is not limited thereto. Each of the first and second guide blocks 1336, 1338 is triangular in a vertical cross section which can pierce water droplets to a great extent.

The intermediate wall 13324 is further provided with two blocking portions 13325 respectively corresponding in position to the tubular stubs 1333 for preventing the condensate from directly flowing into the tubular stubs 1333 through the first or second channels 1335, 1337 and for dispersing the steam ejected from the tubular stubs 1333.

The chamber 1332 has a rectangular shape. The first channels 1335 extend along a length direction of the chamber 1332. In this embodiment, the connecting passage includes the through passages 1331 provided in the side walls 13323 of the chamber 1332. However, the first and second channels 1335, 1337 may also serve as connecting passages. Condensate can directly flow back into the chamber 1332 through the first and second channels 1335, 1337. Since the first and second channels 1335, 1337 are arranged in stagger, and through the provision of the blocking portions 13325, condensate will not flow back into the tubular stubs 1333, and the first and second guide blocks 1336, 1338 can accelerate the flow of the condensate into the chamber 1332.

The steam diverging device 133 further includes a filter member 1139 surrounding the chamber 1332.

In operation, a user first takes out the telescopic tubes 4 from the receiving groove 111 of the base plate 10, after which the cover body 2 and the cloth cover 3 are removed from the top wall 112 of the upper housing 11. Next, the telescopic tubes 4 are extended and the first ends thereof are inserted into the respective insertion holes 1121, the cover body 2 is connected to the second ends of the telescopic tubes 4, and the cloth cover 3 is positioned between the top wall 112 of the upper housing 11 and the cover body 2 and between the telescopic tubes 4 to define the space 30. Then, the user hangs the clothes (not shown) on the hanging member 21, and activates the steam dryer 100. Subsequently, the pumping device 136 pumps water in the container 131 to the steam generator 132, water in the steam generator 132 is converted into steam, and the steam flows into the steam diverging device 133 through the guide pipe 134. Afterwards, steam is ejected through the tubular stubs 1333 and is dispersed by the blocking portions 13325. The dispersed steam then flows consecutively through the second channels 1337 and the first channels 1335 and into the space 30. During flowing of the dispersed steam into the second channels 1337 and the first channels 1335, large water droplets contained in the steam are pierced by the second guide blocks 1338 and the first guide blocks 1336 into smaller droplets. The wrinkles of the clothes hung in the space 30 are softened under the action of high temperature steam, and are flattened under the action of their own weight. Then, the blowing device 12 is activated to blow dry the clothes.

Since steam still remains in the space 30, after a period of time or during the operation of the blowing device 12, the steam will condense to form condensate which drips to the bottom portion of the space 30 and flows into the chamber 1332. From the chamber 1332, the condensate then flows into the container 131 through the return pipe 135.

The beneficial effects of this disclosure can be summarized as follows:

1. The steam generated by the steam generator 132 is ejected through the steam diverging device 133 into the space 30, and the steam diverging device 133 includes the connecting passage communicating with the space 30. The condensate or condensed water formed by the condensation of the steam flows back to the container 131 through the steam diverging device 133, thereby effectively solving the problem of water accumulation caused by condensation. The water flowing back to the container 131 is recycled, which saves resources and eliminates odor and pollution problems in the waste water tank of the conventional steam dryer, thereby effectively solving the problem of condensate backlog.
2. The steam diverging device 133 is disposed higher than the container 131, so that the condensed water in the steam diverging device 133 can flow toward the container under the action of gravity.
3. The steam diverging device 133 includes the two tubular stubs 1333 protruding upwardly from the bottom wall 13321 of the chamber 1332 and connected to the steam generator 132. The tubular stubs 1333 prevent the condensate in the chamber 1332 from flowing back to the steam generator 132.
4. The upper wall 13322 of the chamber 1332 is provided with the first guide blocks 1336 for piercing water droplets contained in the steam into smaller droplets.
5. The intermediate wall 13324 of the chamber 1332 is provided with the second guide blocks 1338 staggered with the first guide blocks 1336. Through this staggered arrangement, when water droplets contained in the steam directly flow through the second channels 1337 without being pierced by the second guide blocks 1338, the first guide blocks 1336 can pierce the water droplets before they flow through the first channels 1335.
6. Each of the first and second guide blocks 1336, 1338 is triangular in a vertical cross section. The sharp corners of the triangle can pierce the water droplets to a great extent. Further, the hypotenuse of each triangle can also guide the flow of steam or water.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A drainage device for a steam dryer defining a space, said drainage device comprising:
   a container;
   a steam generator connected to said container; and
   a steam diverging device connected to said container and said steam generator and disposed higher than said container;

wherein said container supplies water to said steam generator;

wherein said steam diverging device includes a connecting passage for communicating with the space; and wherein said steam generator generates steam that is ejected through said steam diverging device into the space, and water generated by the condensation of the steam flows back to said container through said steam diverging device;

wherein said steam diverging device further includes a chamber having a bottom wall, at least one tubular stub protruding upwardly from said bottom wall and connected to said steam generator, and an upper wall provided with at least two first channels and at least one first guide block disposed between said at least two first channels, said at least one first guide block extending downwardly from said upper wall and gradually decreasing in diameter toward said bottom wall of said chamber.

2. The drainage device as claimed in claim 1, further comprising a pumping device disposed between said steam generator and said container for pumping the water in said container to said steam generator.

3. The drainage device as claimed in claim 1, wherein said chamber further has four side walls, and said connecting passage includes a plurality of through passages provided in said side walls.

4. The drainage device as claimed in claim 1, wherein said bottom wall of said chamber is disposed higher than said container.

5. The drainage device as claimed in claim 4, wherein said steam diverging device further includes a water outlet communicating with said chamber and said container, said water outlet being located at the lowest point of said bottom wall of said chamber.

6. The drainage device as claimed in claim 1, wherein said chamber further has an intermediate wall located between said bottom wall and said upper wall, said intermediate wall being provided with at least two second channels and at least one second guide block disposed between said at least two second channels, said at least one second guide block extending downwardly from said intermediate wall and gradually decreasing in diameter toward said bottom wall of said chamber, said at least one second guide block being staggered with said at least one first guide block.

7. The drainage device as claimed in claim 6, wherein each of said first guide blocks and said second guide blocks is triangular in a vertical cross section.

8. A steam dryer defining a space for accommodating clothes to be dried and comprising:

a drainage device including a container, a steam generator connected to said container, and a steam diverging device connected to said container and said steam generator and disposed higher than said container;

wherein said container supplies water to said steam generator;

wherein said steam diverging device includes a connecting passage communicating with said space; and wherein said steam generator generates steam that is ejected through said steam diverging device into said space, and water generated by the condensation of the steam flows back to said container through said steam diverging device;

wherein said steam diverging device further includes a chamber having a bottom wall, at least one tubular stub protruding upwardly from said bottom wall and connected to said steam generator, and an upper wall provided with at least two first channels and at least one first guide block disposed between said at least two first channels, said at least one first guide block extending downwardly from said upper wall and gradually decreasing in diameter toward said bottom wall of said chamber.

9. The steam dryer as claimed in claim 8, wherein said drainage device further includes a pumping device disposed between said steam generator and said container for pumping the water in said container to said steam generator.

10. The steam dryer as claimed in claim 8, wherein said chamber further has four side walls, and said connecting passage includes a plurality of through passages provided in said side walls.

11. The steam dryer as claimed in claim 8, wherein said bottom wall of said chamber is disposed higher than said container.

12. The steam dryer as claimed in claim 11, wherein said steam diverging device further includes a water outlet communicating with said chamber and said container, said water outlet being located at the lowest point of said bottom wall of said chamber.

13. The steam dryer as claimed in claim 8, wherein said chamber further has an intermediate wall located between said bottom wall and said upper wall, said intermediate wall being provided with at least two second channels and at least one second guide block disposed between said at least two second channels, said at least one second guide block extending downwardly from said intermediate wall and gradually decreasing in diameter toward said bottom wall of said chamber, said at least one second guide block being staggered with said at least one first guide block.

14. The steam dryer as claimed in claim 13, wherein each of said first guide blocks and said second guide blocks is triangular in a vertical cross section.

* * * * *